US008079344B2

(12) United States Patent
Hilberer et al.

(10) Patent No.: US 8,079,344 B2
(45) Date of Patent: Dec. 20, 2011

(54) DEVICE FOR GENERATING COMPRESSED AIR FOR A VEHICLE AND METHOD FOR OPERATING A DEVICE FOR GENERATING COMPRESSED AIR

(75) Inventors: Eduard Hilberer, Hockenheim (DE); Michael Herges, Munich (DE); Gernot Melcher, Munich (DE)

(73) Assignee: Knorr-Bremse Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/819,775

(22) Filed: Jun. 21, 2010
(Under 37 CFR 1.47)

(65) Prior Publication Data

US 2011/0139095 A1 Jun. 16, 2011

Related U.S. Application Data

(63) Continuation of application No. PCT/EP2008/010462, filed on Dec. 10, 2008.

(30) Foreign Application Priority Data

Dec. 20, 2007 (DE) ..... 10 2007 061 420

(51) Int. Cl.
*F02D 13/04* (2006.01)

(52) U.S. Cl. ..... 123/321; 123/327

(58) Field of Classification Search ..... 123/321, 123/322, 327, 389, 391, 58.8, 568.13, 90.11, 123/90.15, 559.1
See application file for complete search history.

(56) References Cited

U.S. PATENT DOCUMENTS

| | | | | |
|---|---|---|---|---|
| 4,860,716 | A | 8/1989 | Deutschmann | |
| 5,150,678 | A | 9/1992 | Wittmann et al. | |
| 5,404,852 | A | 4/1995 | Frankle | |
| 5,636,611 | A | 6/1997 | Frankle et al. | |
| 6,050,239 | A | 4/2000 | Frankle et al. | |
| 6,223,846 | B1 | 5/2001 | Schechter | |
| 6,328,003 | B1 | 12/2001 | Gaertner et al. | |
| 6,568,186 | B2 * | 5/2003 | Zaleski | 60/698 |
| 7,409,943 | B2 * | 8/2008 | Benz et al. | 123/321 |
| 7,946,269 | B2 * | 5/2011 | Gerum et al. | 123/321 |
| 2005/0182553 | A1 | 8/2005 | Miller et al. | |

FOREIGN PATENT DOCUMENTS

| | | |
|---|---|---|
| DE | 199 773 | 6/1908 |
| DE | 36 31 284 C1 | 4/1987 |
| DE | 39 22 884 A1 | 1/1991 |
| DE | 43 09 860 C1 | 6/1994 |
| DE | 197 35 822 C1 | 10/1998 |
| DE | 198 37 094 C1 | 2/2000 |

(Continued)

OTHER PUBLICATIONS

German Office Action dated Jan. 27, 2009 including English-language translation (Ten (10) pages).

(Continued)

*Primary Examiner* — Hai Huynh
(74) *Attorney, Agent, or Firm* — Crowell & Moring LLP

(57) ABSTRACT

A prime mover is provided for a vehicle having a plurality of cylinder chambers, a manifold, and engine brake valves by which the cylinder chambers can be connected to the manifold. A valve or nozzle is disposed on the manifold, by which the manifold can be connected to a feed line of a compressed air treatment system.

13 Claims, 2 Drawing Sheets

FOREIGN PATENT DOCUMENTS

| | | | |
|---|---|---|---|
| DE | 199 02 052 | A1 | 7/2000 |
| EP | 0 737 800 | A2 | 10/1996 |
| GB | 1 480 247 | | 7/1977 |
| JP | 2004-278506 | A | 10/2004 |

OTHER PUBLICATIONS

International Search Report dated Apr. 7, 2009 including English-language translation Six (6) pages).

* cited by examiner

DEVICE FOR GENERATING COMPRESSED AIR FOR A VEHICLE AND METHOD FOR OPERATING A DEVICE FOR GENERATING COMPRESSED AIR

CROSS-REFERENCE TO RELATED APPLICATIONS

This application is a continuation of PCT International Application No. PCT/EP2008/010462, filed Dec. 10, 2008, which claims priority under 35 U.S.C. §119 from German Patent Application No. DE 10 2007 061 420.0, filed Dec. 20, 2007, the entire disclosures of which are herein expressly incorporated by reference.

BACKGROUND AND SUMMARY OF THE INVENTION

The invention relates to a prime mover for a vehicle, such as an engine or motor, having a plurality of cylinder chambers, a manifold and engine brake valves, which serve to connect the cylinder chambers to the manifold.

The invention further relates to a method for supplying a vehicle having a prime mover with compressed air, the prime mover having a plurality of cylinder chambers, a manifold and engine brake valves, which serve to connect the cylinder chambers to the manifold.

Modern vehicles, for example commercial vehicles and passenger vehicles in road transport or in rail transport on railroads, have many compressed air consumers, the compressed air requirement of which is usually met by a compressed air supply system, which includes a compressor. The air-consuming devices (or loads) may include a service brake and a pneumatic suspension, for example. The compressed air-generating compressor is usually driven directly by the prime mover, which is also used to propel the vehicle.

One disadvantage is that a compressor is actually needed in order to generate compressed air in the vehicle, but such a compressor takes up the overall space and increases the weight of the vehicle.

The object of the invention is to obviate the need, in normal operation, for a compressor with which to generate compressed air for the vehicle.

This object is achieved by a prime mover for a vehicle having a plurality of cylinder chambers, a manifold, and engine brake valves, which brake valves serve to connect the cylinder chambers to the manifold. A valve, which serves to connect the manifold to a feed line of a compressed air treatment system, is arranged on the manifold.

Advantageous embodiments of the invention are described herein.

The invention is based on the prime mover of generic type in that a valve, which serves to connect the manifold to a feed line of a compressed air treatment system, is arranged on the manifold. During engine braking, the prime mover of the vehicle is used to dissipate kinetic energy. At the same time, fuel injection into the cylinder chambers of the prime mover is interrupted in order to save fuel, the braking power being provided through compression work and the internal friction of the prime mover. The same applies during a coasting phase, the braking action of the prime mover here being undesirable, for which reason the air in the cylinder chambers is not compressed, but rather is pumped to and fro between the cylinder chambers via a manifold. By arranging a valve on the manifold it is possible, during engine braking or a coasting phase, to generate compressed air for the vehicle, which can be fed to the compressed air treatment system via the feed line.

The engine brake valves may usefully be individually actuated by an engine control unit. The individual actuation of the engine brake valves allows the specific connection of the individual cylinder chambers to the manifold during their respective compression strokes. The engine brake valves may advantageously be pilot-controlled by valve devices.

The invention further relates to a system for supplying a vehicle having a prime mover according to the invention with compressed air, and to a compressed air treatment system for treating the compressed air generated. Such a system is capable of providing compressed air for the individual consumers without a compressor.

In particular, a connection, from which untreated compressed air can be drawn, may be provided on the feed line. Consumers which only need compressed air of lower quality may be supplied with untreated compressed air from this connection, thereby relieving the compressed air treatment system.

The method of generic type is further developed in that the manifold is connected to a feed line of a compressed air treatment system by way of a valve. In this way the advantages and particular features of the prime mover according to the invention are also translated into a method.

This also applies to the especially preferred embodiments of the method according to the invention described below.

This method is usefully further developed in that during engine braking only the cylinder chamber in which compression work is currently being performed is connected to the manifold. Furthermore, during a coasting phase of the prime mover only the cylinder chamber in which compression work is currently being performed is connected to the manifold.

Some of the cylinder chambers can advantageously be connected to the manifold during their compression phase, whilst the remaining cylinder chambers are operated normally. In the absence of engine braking and also of any coasting phase, the prime mover can also be used to generate compressed air during a load phase. In this case, some of the cylinder chambers of the prime mover are used to generate compressed air, whilst the remaining cylinder chambers are used to drive the vehicle.

Preferably, no fuel is fed into the cylinder chambers which are connected to the manifold during the next compression phase. This measure serves to increase the quality of the compressed air generated by the prime mover, since the quantity of combustion residues and exhaust gases is reduced by a scavenging cycle that can be achieved in this way.

It is especially preferred that no fuel is fed into the cylinder chambers which are connected to the manifold during the next compression phase but one. If two scavenging cycles are performed in succession, the quality of the compressed air generated by the prime mover can be further improved.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
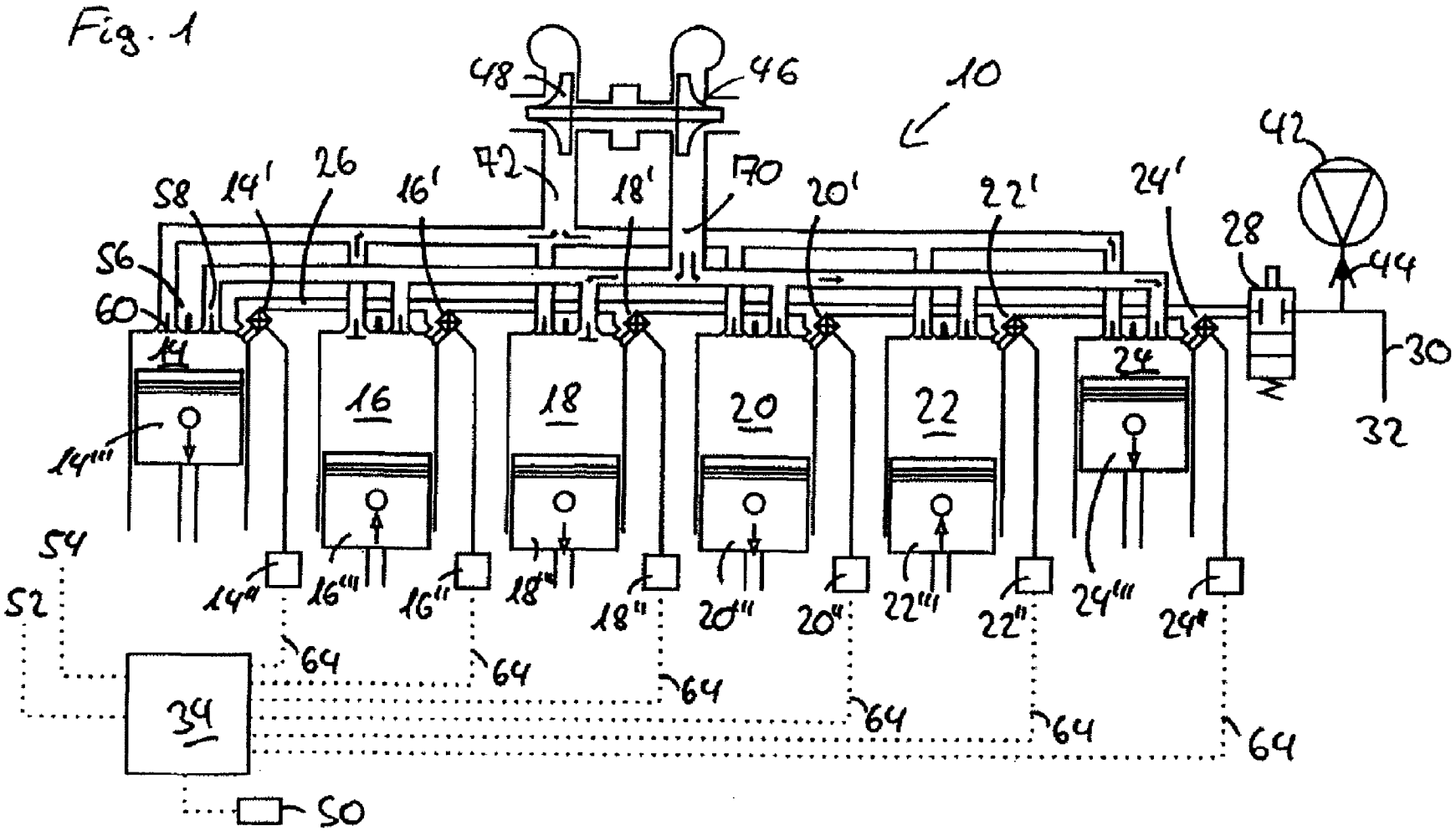
FIG. 1 shows a schematic representation of a prime mover according to the invention.

In the following the same reference numerals are used to denote the same or similar parts.

FIG. 1 shows a schematic representation of a prime mover according to the invention. The term prime mover means any appropriate drive unit such as an engine or motor. The prime mover 10 represented includes cylinder chambers 14, 16, 18, 20, 22, 24 in which pistons 14''', 16''', 18''', 20''', 22''', 24''' move periodically up and down. By way of an inlet valve 58 arranged on each cylinder chamber 14, 16, 18, 20, 22, 24 fresh air compressed by a compressor 46 can be fed via an intake line 70 to the cylinder chambers 14, 16, 18, 20, 22, 24. Fuel is fed to the cylinder chambers 14, 16, 18, 20, 22, 24 in each case via an injection nozzle 56, whilst the exhaust gases can be delivered by an exhaust valve 60 via an exhaust line 72 to a turbine 48 and thereby used to drive the compressor 46.

Also arranged between the individual cylinder chambers 14, 16, 18, 20, 22, 24 is a manifold 26, which is sealed off from the individual cylinder chambers 14, 16, 18, 20, 22, 24 by engine brake valves 14', 16', 18', 20', 22', 24'. The engine brake valves 14', 16', 18', 20', 22', 24' are each pilot-controlled by valve devices 14", 16", 18", 20", 22", 24", the valve devices 14", 16", 18", 20", 22", 24" in turn being actuated by an engine control unit 34 via control lines 64. The engine control unit 34 is furthermore capable, by way of a sensor 50, of detecting the position of a crankshaft (not shown) of the prime mover 10, and by way of a connection to the valve timing gear 54 and a connection to the injection control 52 controls the injection nozzles 56 and the inlet and exhaust valves 58, 60. The engine control unit 34 is furthermore capable, via a signal line (not shown), of controlling a valve 28, which is arranged between the manifold 26 and a feed line 30, which feed line leads to a compressed air treatment system 32. Also shown is a compressor 42, which is likewise coupled by way of a non-return valve 44 to the feed line 30.

When the prime mover 10 is in an engine braking phase, the fuel feed via the injection nozzles 56 is interrupted by the engine control unit 34, whilst the air from the prime mover 10 is fed via the exhaust line 72, the turbine 48 and a virtually closed throttle valve (not shown) arranged downstream of the turbine 48. If this air is to be used for the vehicle compressed air supply, the corresponding engine brake valve 14'; 16'; 18'; 20'; 22'; 24' can be opened during the compression stroke, whilst the corresponding inlet and exhaust valves 58, 60 are closed, and the air is forced into the manifold 26. If the valve 28 is simultaneously switched into its connect position (not shown), the expelled air can pass via the feed line 30 to the compressed air treatment system 32.

If the prime mover 10 is in a coasting phase, the fuel feed via the injection nozzles 56 is likewise interrupted by the engine control unit 34. Since the prime mover 10 is intended to dissipate as little kinetic energy as possible during a coasting phase, the air present in the cylinder chambers 14, 16, 18, 20, 22, 24 is not compressed during the compression stroke, but through suitable actuation of the engine brake valves 14', 16', 18', 20', 22', 24' is pumped or drawn via the manifold 26 into those cylinder chambers 14, 16, 18, 20, 22, 24 that are currently performing an intake stroke. If the air pumped or drawn through the manifold 26 is to be used for the vehicle compressed air supply, the engine brake valves 14', 16', 18', 20', 22', 24' of the cylinder chambers 14, 16, 18, 20, 22, 24 that are currently performing an intake stroke may simply remain closed, whilst the valve 28 is simultaneously brought into its connect position (not shown). In this way the air forced into the manifold 26 during the compression stroke can likewise pass via the feed line 30 to the compressed air treatment system 32.

It is important that the compressed air is delivered during the compression stroke of the respective cylinder chamber 14, 16, 18, 20, 22, 24 and that the associated engine brake valve 14', 16', 18', 20', 22', 24' is opened together with the pintle valve 28 during the compression stroke. If compressed air is to be generated in the absence of engine braking or a coasting phase, this can be done by way of a separate compressor 42, which is likewise coupled to the feed line 30. It is also possible, however, to interrupt the fuel feed via the injection nozzle 56 for one or more cylinder chambers 14, 16, 18, 20, 22, 24 and to open the associated engine brake valve 14', 16', 18', 20', 22', 24' during their compression stroke, in order to be able to generate compressed air. The cylinder chambers 14, 16, 18, 20, 22, 24, the fuel feed to which has not been interrupted, meanwhile continue to be operated normally.

It is also feasible here to use a different cylinder chamber 14, 16, 18, 20, 22, 24 in each cycle for delivering compressed air, in order to improve the smooth running of the prime mover 10 or for better control of the heat generated inside the prime mover 10. Looking at the torque development spectrum and the maximum possible torque per piston 14''', 16''', 18''', 20''', 22''', 24''', given optimization of the duration of injection and the fuel injection quantity, the driver will not notice any loss of power due to the use of one or more cylinder chambers 14, 16, 18, 20, 22, 24 for delivering compressed air. Due to the large swept volume of the prime mover 10, the prime mover 10 takes only a very brief time to deliver a large quantity of air. The prime mover delivers approximately ten times the volume of air per unit time compared to a conventional compressor. Since the valve timing gear is still very rapid and robust, outstanding use can be made of even the briefest coasting phases or set torque flat spots. Without supercharging, the air pressure attainable here is in the order of approximately 13 bar. Given typical supercharging of one percent, 16 bar is also achievable and the compressor characteristics map is replaced by the compression characteristics map of the prime mover 10. Owing to the modified method for delivering compressed air, it is to be anticipated that an additional or improved air cooling, for example through an extended cooling coil in the feed line 30, an improved preliminary filtering and an oil separation designed for large oil quantities might be necessary. It is also feasible to raise the overall pressure level of the vehicle compressed air system, since the prime mover 10 is capable of providing higher delivery pressures than a compressor 42 conventionally used.

Figure 2:
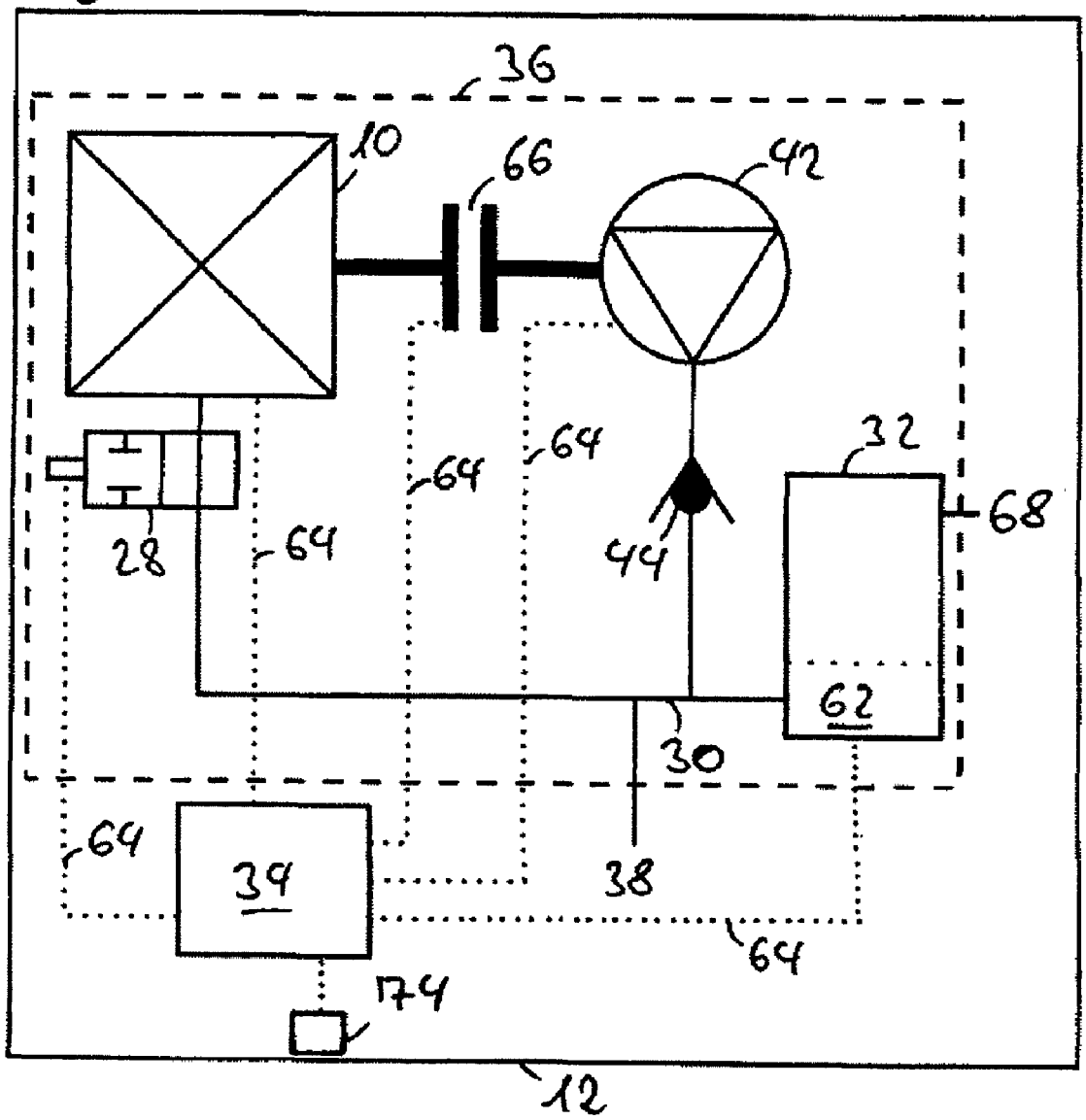
FIG. 2 shows a schematic representation of a system according to the invention.

FIG. 2 shows a schematic representation of a system according to the invention. The system 36 located in a vehicle 12 includes a prime mover 10 according to the invention, having a pintle valve 28 and a compressed air treatment system 32. Also provided in the compressed air treatment system 32 is a preliminary filter 62, which takes account of the increased level of contamination of the compressed air delivered by the prime mover 10 according to the invention. A consumer 68 is connected to the compressed air treatment system on the output side. A compressor 42, which can be driven from the prime mover 10 by way of a clutch 66, is furthermore arranged on the feed line 30 connecting the prime mover 10 and the compressed air treatment system 32, downstream of a non-return valve 44. If the prime mover 10 is in neither an engine braking phase nor a coasting phase and is not designed to deliver compressed air during a load phase, the clutch 66 can be closed and compressed air can be delivered to the compressed air treatment system 32 by the compressor 42. Also branching off from the feed line 30 upstream of the compressed air treatment system 32 is a connection 38, via which the untreated compressed air can be drawn off. The system 36 is controlled by an engine control unit 34. For this purpose the engine control unit 34 is coupled via control lines 64 to the prime mover 10, the pintle valve 28, the compressor 42, the clutch 66 and the compressed air treatment system 32.

The engine control unit 34 is furthermore capable, by way of a pressure sensor 74, of determining a pressure prevailing in the compressed air system of the vehicle 12. In this way the engine control unit 34 can detect whether a compressed air delivery by the prime mover 10 or the compressor 42 is needed.

TABLE OF REFERENCE NUMERALS

10 prime mover
12 vehicle
14 cylinder chamber
14' engine brake valve
14" valve device
14'" piston
16 cylinder chamber
16' engine brake valve
16" valve device
16'" piston
18 cylinder chamber
18' engine brake valve
18" valve device
18'" piston
20 cylinder chamber
20' engine brake valve
20" valve device
20'" piston
22 cylinder chamber
22' engine brake valve
22" valve device
22'" piston
24 cylinder chamber
24' engine brake valve
24" valve device
24'" piston
26 manifold
28 valve (nozzle)
30 feed line
32 compressed air treatment system
34 engine control unit
36 system
38 connection
42 compressor
44 non-return valve
46 compressor
48 turbine
50 sensor
52 injection control
54 valve timing gear
56 injection nozzle
58 inlet valve
60 exhaust valve
62 preliminary filter
64 control line
66 clutch
68 consumer
70 intake line
72 exhaust line
74 pressure sensor The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A prime mover for a vehicle having a compressed air treatment system, comprising:
a plurality of cylinder chambers;
a manifold;
engine brake valves, said engine brake valves serving to couple the cylinder chambers to the manifold; and
a valve arranged on the manifold, said valve being operatively configured to couple the manifold to a feed line of the compressed air treatment system.

2. The prime mover according to claim 1, wherein the engine brake valves are individually actuated via an engine control unit.

3. The prime mover according to claim 2, wherein the engine brake valves are pilot-controlled by valve devices.

4. The prime mover according to claim 1, wherein the engine brake valves are pilot-controlled by valve devices.

5. A system for supplying a vehicle with compressed air, the system comprising:
a compressed air treatment system having a feed line;
a prime mover operatively configured to drive the vehicle, the prime mover comprising:
a plurality of cylinder chambers;
a manifold;
engine brake valves, said engine brake valves serving to couple the cylinder chambers to the manifold; and
a valve arranged on the manifold, said valve being operatively configured to couple the manifold to the feed line of the compressed air treatment system.

6. The system according to claim 5, further comprising a feed line connection from which untreated compressed air can be drawn.

7. A method for supplying a vehicle having a prime mover and a compressed air treatment system with compressed air, the method comprising the acts of;
selectively coupling a manifold of the prime mover in which engine brake valves serve to connect a plurality of cylinder chambers to the manifold, to a feed line of the compressed air treatment system by way of a valve; and
supplying the compressed air treatment system with compressed air via the coupling by way of the valve.

8. The method according to claim 7, further comprising the act of connecting only a cylinder chamber in which compression work is currently being performed during engine braking to the manifold.

9. The method according to claim 8, further comprising the act of connecting only a cylinder chamber in which compression work is currently being performed during a coasting phase of the prime mover to the manifold.

10. The method according to claim 7, further comprising the act of connecting only a cylinder chamber in which compression work is currently being performed during a coasting phase of the prime mover to the manifold.

11. The method according to claim 7, wherein some of the cylinder chambers are connected to the manifold during their compression phase while remaining cylinder chambers are operated normally.

12. The method according to claim 7, wherein fuel is not fed into cylinder chambers connected to the manifold during a next compression phase.

13. The method according to claim 12, wherein fuel is not fed into the cylinder chambers connected to the manifold during a next but one compression phase.

* * * * *